US012167809B2

(12) United States Patent
Aresu

(10) Patent No.: US 12,167,809 B2
(45) Date of Patent: Dec. 17, 2024

(54) APPARATUS FOR RECEIVING MAIL AND PARCELS AND RESPECTIVE OPERATING METHOD

(71) Applicant: Daniele Aresu, Montano Lucino (IT)

(72) Inventor: Daniele Aresu, Montano Lucino (IT)

( * ) Notice: Subject to any disclaimer, the term of this patent is extended or adjusted under 35 U.S.C. 154(b) by 399 days.

(21) Appl. No.: 17/502,121

(22) Filed: Oct. 15, 2021

(65) Prior Publication Data

US 2022/0117430 A1 Apr. 21, 2022

(30) Foreign Application Priority Data

Oct. 16, 2020 (IT) ..... 102020000024487

(51) Int. Cl.
*A47G 29/14* (2006.01)
*A47G 29/122* (2006.01)
*A47G 29/124* (2006.01)

(52) U.S. Cl.
CPC ..... *A47G 29/141* (2013.01); *A47G 29/1225* (2013.01); *A47G 29/124* (2013.01); *A47G 2029/1226* (2013.01); *A47G 2029/1257* (2017.08); *A47G 2029/142* (2013.01); *A47G 2029/148* (2013.01)

(58) Field of Classification Search
CPC ..... A47G 29/141; A47G 29/20; A47G 29/22; A47G 29/124; A47G 29/1225; A47G 2029/148; A47G 2029/149; A47G 2029/1226; A47G 2029/1257; A47G 2029/142; G06Q 10/083; G06Q 10/0836; G07C 9/00896; G07C 9/00912; E05B 65/0075
See application file for complete search history.

(56) References Cited

U.S. PATENT DOCUMENTS

| | | | | |
|---|---|---|---|---|
| 9,418,495 | B2 | 8/2016 | Mackin et al. | |
| 10,039,401 | B1 * | 8/2018 | Romanucci | A47G 29/141 |
| 10,772,450 | B2 * | 9/2020 | Waisanen | A47C 11/00 |
| 10,796,512 | B2 * | 10/2020 | Shah | H04L 9/0819 |
| 11,064,832 | B1 * | 7/2021 | Goldstein | A47G 29/141 |
| 11,303,856 | B1 * | 4/2022 | Carter | G07C 9/00174 |
| 11,369,222 | B2 * | 6/2022 | Kennett | E05B 47/00 |

(Continued)

FOREIGN PATENT DOCUMENTS

| | | | | |
|---|---|---|---|---|
| CA | 3100540 | A1 * | 11/2019 | A47G 29/141 |
| CN | 211038390 | U | 7/2020 | |

(Continued)

*Primary Examiner* — William L Miller

(74) *Attorney, Agent, or Firm* — Dickinson Wright PLLC; Andrew D. Dorisio

(57) ABSTRACT

A method of operating an apparatus for receiving one or more mail items is described. The method includes activating the communication between a user interface device and a remote device; generating, by an electronic control unit, at least one random alphanumeric code; sending, via a network interface device, the random alphanumeric code to the remote device; sending, by the remote device and via the network interface device, an unlock signal based on the random alphanumeric code to the electronic control unit. An unlock signal is processed by the electronic control unit to unlock the movable closure element and allow one or more mail items to be introduced in or withdrawn from the internal cavity.

10 Claims, 4 Drawing Sheets

(56) References Cited

U.S. PATENT DOCUMENTS

| | | | | |
|---|---|---|---|---|
| 11,506,445 | B2 * | 11/2022 | Lubben | F25D 23/12 |
| 2013/0043973 | A1 * | 2/2013 | Greisen | G07C 9/00817 340/5.51 |
| 2016/0066733 | A1 * | 3/2016 | Gozar | A47G 29/141 232/18 |
| 2017/0286905 | A1 | 10/2017 | Richardson et al. | |
| 2018/0070753 | A1 * | 3/2018 | Eveloff | H04W 4/025 |
| 2018/0191889 | A1 * | 7/2018 | Gerhardt | G07C 9/00571 |
| 2021/0059455 | A1 * | 3/2021 | Bowman | B65D 81/18 |
| 2022/0395124 | A1 * | 12/2022 | Meddah | G08B 13/1463 |
| 2023/0316218 | A1 * | 10/2023 | Davies | A47G 29/141 705/339 |
| 2024/0127655 | A1 * | 4/2024 | Wright | H04L 9/3239 |

FOREIGN PATENT DOCUMENTS

| | | | |
|---|---|---|---|
| EP | 3612061 | A1 | 2/2020 |
| FR | 3082411 | A1 | 12/2019 |
| GB | 2443212 | A | 4/2008 |
| WO | 2020065550 | A1 | 4/2020 |

* cited by examiner

APPARATUS FOR RECEIVING MAIL AND PARCELS AND RESPECTIVE OPERATING METHOD

This application claims priority to Italian Patent Application No. 102020000024487 filed on Oct. 16, 2020, the disclosure of which is incorporated herein by reference.

DESCRIPTION

The present invention generally relates to an apparatus for receiving mail and parcels and, in particular, a method of operating an interactive electronic apparatus, which is called "Smart Mailbox", for receiving mail, parcels and goods in general.

BACKGROUND

Mailboxes are known which use electronic opening systems, with access code, as an alternative to traditional keys. A mailbox of this type is described, for example, in document EP 3612061 in the name of the same applicant.

The current development of products sale and purchase via the Internet (the so-called "e-commerce") has significantly increased the volumes of mail and, in general, of goods delivered at the intended recipient's address. In the absence of the intended recipient, however, it can happen that the goods are not delivered and are destined to remain in storage at the carrier's warehouse or even, in some cases, they are returned to the sender. However, the current "keyless" electronic apparatuses for receiving mail are not capable in themselves, that is to say if not supported by an effective and adequate operating method, to allow the receipt of mail and goods in a secure manner even in the absence of the intended recipient.

SUMMARY

The object of the present invention is, therefore, to provide a method of operating an interactive electronic apparatus for receiving mail and goods in general which is capable of solving the aforementioned drawbacks of the prior art in an extremely simple, economical and particularly functional way.

In detail, it is an object of the present invention to provide a method of operating an interactive electronic apparatus for receiving mail and goods in general which allows goods delivery and exchange without contact between individuals, hence facilitating the social distancing required by recent measures adopted by world governments regarding policies aimed at slowing the propagation and spread of viruses and pandemics.

Another object of the present invention is to provide a method of operating an interactive electronic apparatus for receiving mail and goods in general which allows carriers to safely deposit the goods in the apparatus even in the absence of the intended recipient.

A further object of the present invention is to provide a method of operating an interactive electronic apparatus for receiving mail and goods in general which allows shops and commercial activities to provide customers with goods delivery services even when closed.

These and other objects according to the present invention will be achieved by providing a method of operating an interactive electronic apparatus for receiving mail and goods in general.

Further features of the invention are highlighted by the dependent claims, which are an integral part of the present description.

BRIEF DESCRIPTION OF THE DRAWINGS

The features and advantages of a method of operating an interactive electronic apparatus for receiving mail and goods in general according to the present invention will be clearer from the following exemplifying and hence non-limiting description, referring to the attached schematic drawings in which.

DETAILED DESCRIPTION

Figure 1:
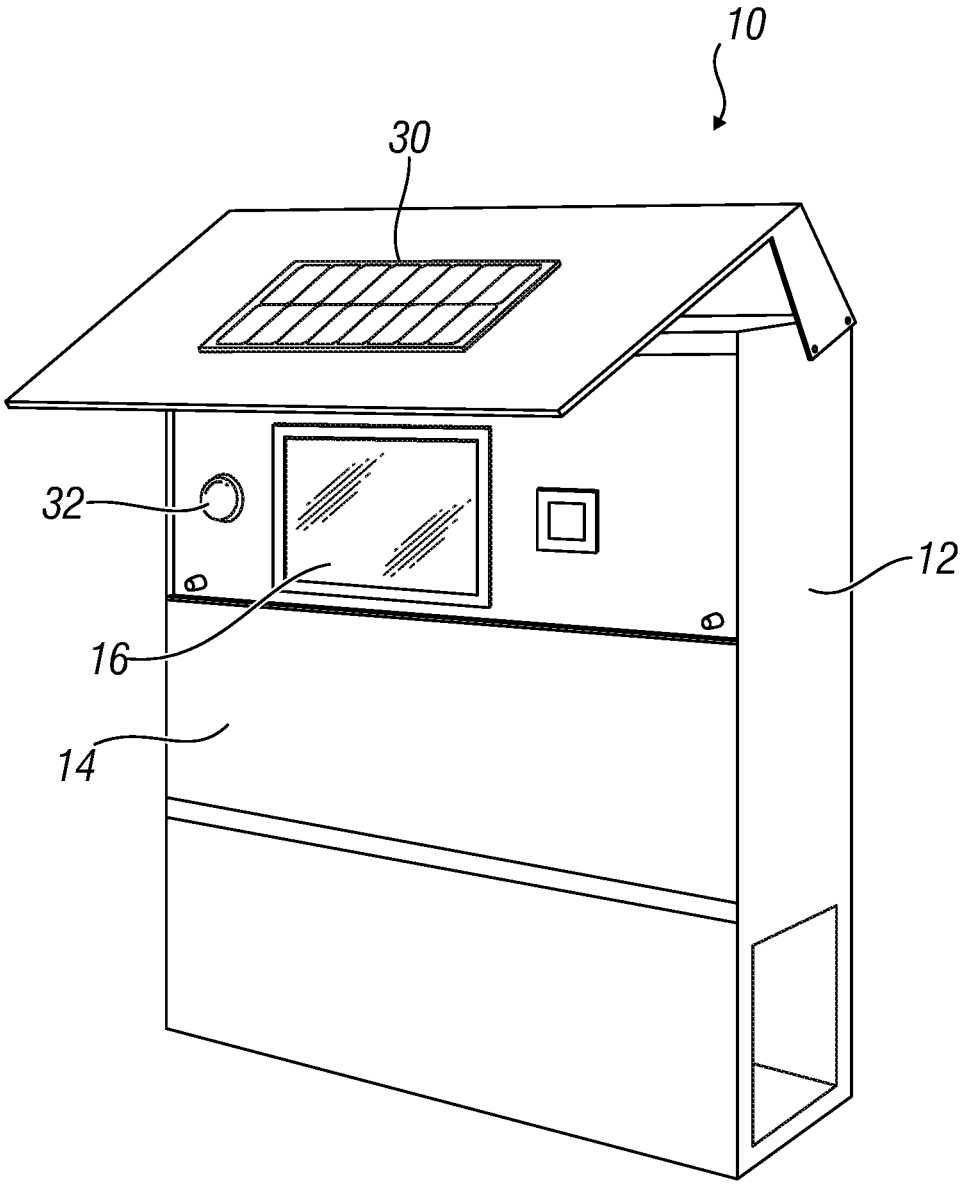
FIG. 1 is a perspective view of an apparatus for receiving mail configured for implementing the operating method according to the present invention.

With reference in particular to FIG. 1, an apparatus for receiving mail configured for implementing the operating method according to the present invention is shown. The apparatus for receiving mail is indicated as a whole with reference number 10. The apparatus 10 is substantially similar, albeit with a different hardware and software architecture, to the one described in document EP 3612061 in the name of the same applicant.

As shown in FIG. 1, the apparatus 10 first of all comprises a body 12 provided with an internal cavity arranged to contain at least one mail item, as well as at least one movable closure element 14 arranged to allow or prevent access to the internal cavity. The apparatus 10 further comprises at least one user interface device 16, configured for allowing the input and output of audio and video signals, at least one network interface device 18, configured for putting the user interface device 16 in communication with at least one remote device 20, and at least one electronic control unit 22, configured for controlling and managing both the user interface element 16, the network interface device 18 and the movable closure element 14. Preferably, the remote device 20 consists of a Smartphone, a tablet or other similar device owned by the same person who also owns the apparatus 10 which, therefore, typically coincides with the intended recipient of the mail items ("receiving person").

Figure 3:
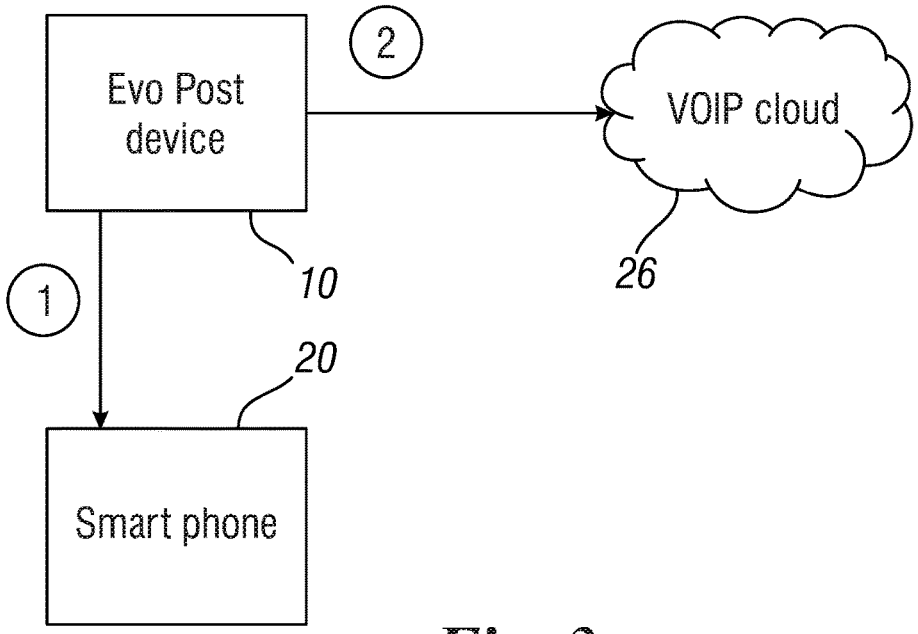
FIG. 3 is a block diagram showing the initial configuration of the apparatus for receiving mail according to the respective operating method.

For example, as indicated in the block diagram of FIG. 3, the user interface device 16 can comprise a tactile touch screen integral with the electronic control unit 22 by means of spacers of the known type or of a suitable (plastic or metallic) frame. The electronic control unit 22 can be equipped with one or more processors capable of running a suitable operating system, such as Linux.

The apparatus 10 is provided with at least one power supply device 28 configured for supplying both the electronic control unit 22 and the various peripherals via, for example, a standard micro-USB connector, so as to allow a high versatility of use. The power supply device 28 can consist of a mains power supply, that is to say which is capable of withdrawing power from the mains power, or from one or more battery packs to be charged autonomously with respect to the apparatus 10. In fact, a charging mode for autonomously charging the battery pack or packs by means of one or more solar panels 30 (FIG. 1) positioned outside the body 12 of the apparatus 10 can be implemented on the apparatus 10. The charging mode for charging the battery pack or packs could in any case be implemented by other renewable energy sources which are alternatives to the solar power.

The electronic control unit 22 is in any case configured for maximizing energy savings. In this respect, a complete shutdown mode for shutting down all the electronic components of the apparatus 10 is provided, for example during the night hours, keeping these components at least in stand-by mode during the desired time slots. Whatever the level of energy savings, the apparatus 10, however, always remains operational, only varying the waiting time necessary before starting the respective operating procedure, which will be described below.

Figure 2:
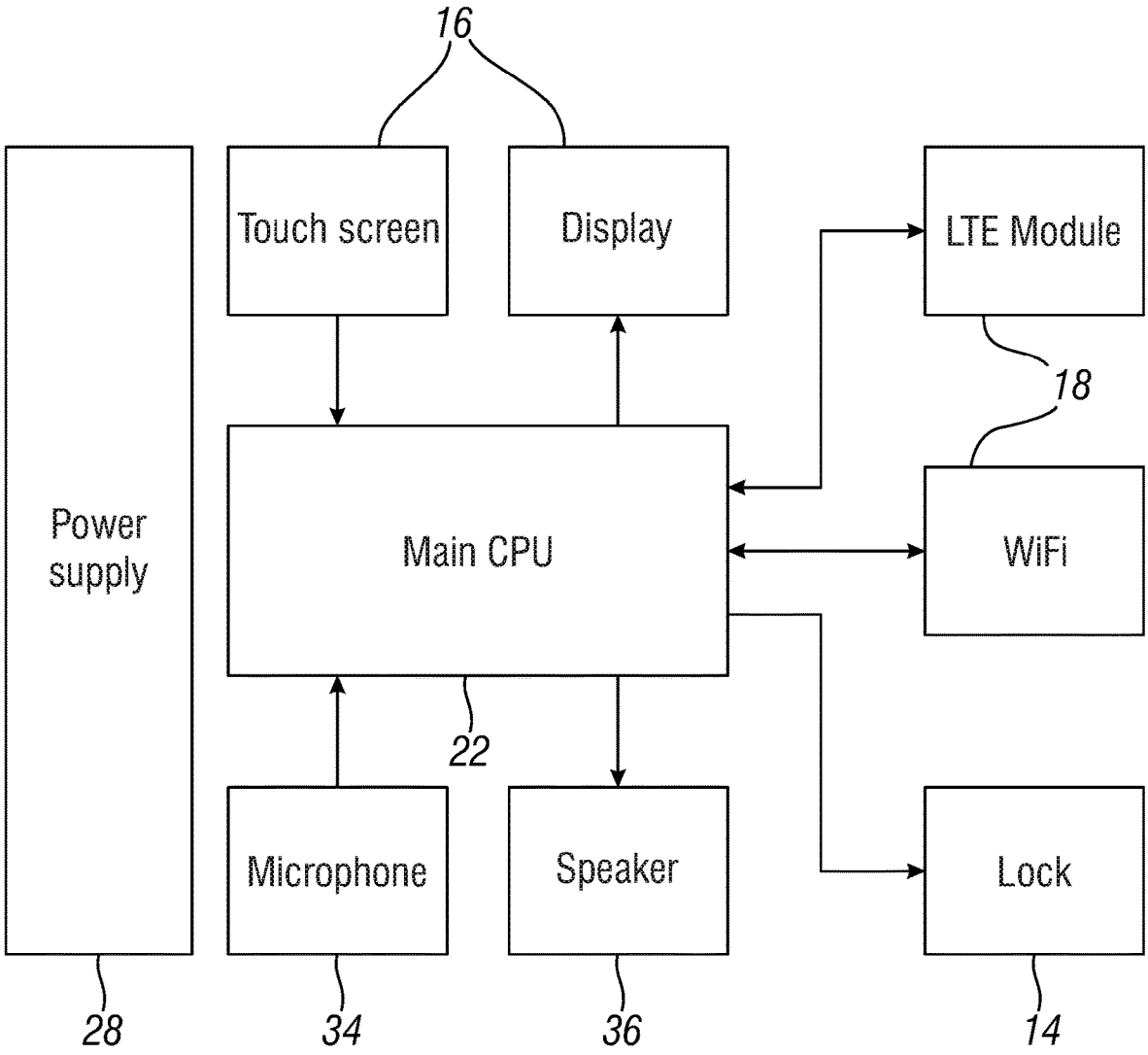
FIG. 2 is a block diagram showing the main components of an apparatus for receiving mail configured for implementing the operating method according to the present invention.

The apparatus 10 can be provided with at least one video camera 32 (FIG. 1) and an audio input (microphone 34, FIG. 2) and output (speaker 36, FIG. 2) system, necessary to establish a video call, preferably using a VoIP technology. The network interface device 18 can comprise both a first interface device that uses an LTE (acronym for "Long Term Evolution") connection standard, which is commonly called "4G", so as to ensure connectivity via cellular network, and a second interface device consisting of a Wi-Fi transceiver, so as to exploit any existing connection.

The network interface device 18 can in any case comprise other interface devices (not shown) suitable for the purpose, such as an interface device that uses a "5G" connection standard. The network interface device 18 can also be configured for connecting the apparatus 10 and the respective peripherals to the internet. The connection to the internet has the advantage of being able to perform firmware updates, diagnostics and maintenance remotely.

The operating procedure of the apparatus 10 described so far is as follows. Upon arrival of a parcel or any mail item, delivered by a carrier which can be, for example, a postman, a courier or other person authorized to deliver mail items ("delivery person"), the communication between the user interface device 16 of the apparatus 10 and the remote device 20, which typically coincides with a Smartphone or tablet owned by the receiving person, who is also the person owning the apparatus 10, is automatically activated. The receiving person is then immediately informed that a mail item destined to him/her is being delivered.

Figure 5:
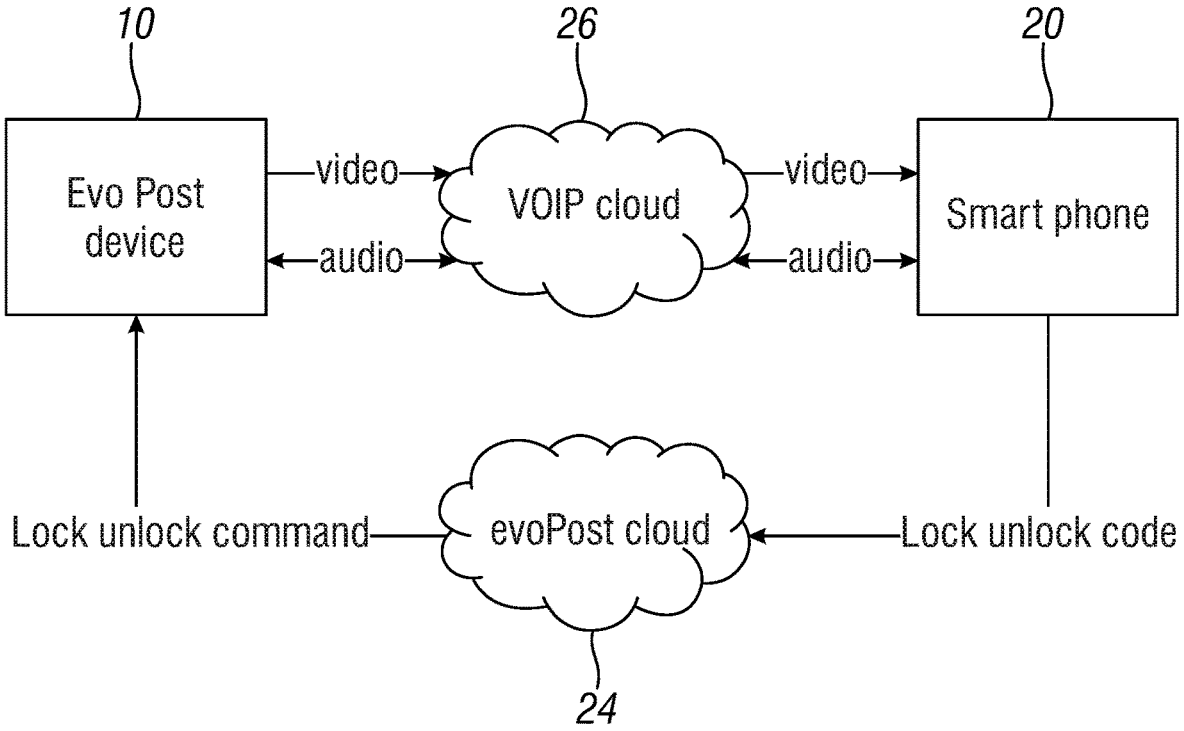
FIG. 5 is a block diagram showing another operating mode of the apparatus for receiving mail according to the respective operating method.

Once the communication is activated, the electronic control unit 22 of the apparatus 10 generates at least one random alphanumeric code which is sent to the remote device 20 via the network interface device 18. If the receiving person decides that the apparatus 10 can be opened in order to allow the delivery person to introduce the mail item, this same receiving person can send an unlock signal based on the random alphanumeric code just received to the electronic control unit 22 of the apparatus 10, via his/her remote device 20 and the network interface device 18. The unlock signal is processed by the electronic control unit 22 to unlock the movable closure element 14 of the apparatus 10 so as to allow the mail item to be introduced in the internal cavity of said body 12 of the apparatus 10 by the delivery person. This operating procedure is schematically illustrated in FIG. 5.

Otherwise, if the owner of the apparatus 10 wishes to open this apparatus 10 to allow the withdrawal, rather than the introduction, of a mail or goods item in general from the internal cavity of the body 12 of this apparatus 10, the operating procedure would be basically the same. In this case, however, the intended recipient would be the one who is in the vicinity of the apparatus 10 and who wishes to take possession of the goods contained therein. In this case, for example, the receiving person could be a store customer and the apparatus 10 would be the property of that store. The delivery person would be, instead, the owner of the remote device 20 and possibly of the apparatus 10. For example, the delivery person could be the shop manager, or a clerk in charge of managing and using the apparatus 10.

Figure 4:
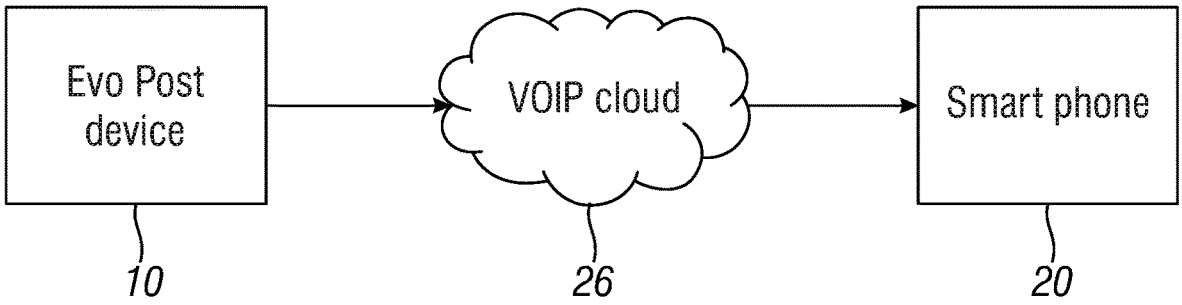
FIG. 4 is a block diagram showing an operating mode of the apparatus for receiving mail according to the respective operating method.

If, in both the above described situations, the owner of the apparatus 10 is not available to activate the communication between the user interface device 16 and the remote device 20 or, in other words, if the owner of the apparatus 10 cannot respond to the video call established by the apparatus 10, the postman/courier (or the shop customer) could send a message to the owner of the apparatus 10 via the user interface device 16 and the network interface device 18, to inform him/her of the goods delivery (or collection) attempt. The message could be of any type, that is audio and/or video and/or text. This operating procedure is schematically illustrated in FIG. 4. Again, in case of absence and/or unavailability of the owner of the apparatus 10 to make the video call, the user interface device 16 could in any case offer the alternative possibility of opening the apparatus 10 by means of a secret code previously communicated by the owner himself/herself to the person who wishes to have access to the apparatus 10 itself.

All the information and/or data exchanged between the apparatus 10 and the remote device 20 are managed by one or more cloud servers 24, 26. In particular, the user interface device 16 and the remote device 20 can communicate with each other through one or more audio-video calls using a VoIP technology. A dedicated VoIP server 26 is then installed on the cloud infrastructure, together with all the services necessary for remote management of the apparatus 10. Choosing a standard VoIP technology allows the development of customized applications, for example in a Linux environment, on the hardware architecture of the apparatus 10, guarantees interoperability between similar apparatuses 10 located at a distance from each other and allows any VoIP application existing on the market to be used to send and receive calls from the remote device 20, thus not binding the use of the apparatus 10 to a corresponding use of external services belonging to subjects other than the owner of this apparatus 10.

FIG. 3 shows the initial configuration procedure of the apparatus 10. This procedure involves the following steps:

- acquiring, by said remote device 20, a unique code associated with the apparatus 10; for example, this unique code can consist of a QR code which is stamped on the body 12 of the apparatus 10 and can be acquired via any Smartphone;
- transmitting the unique code to one of the cloud servers 24, 26, such as the VoIP server 26, via the user interface device 16;
- registering the unique code and one or more predefined data associated with the remote device 20 on the VoIP server 26.

Further remote devices 20 can, therefore, be associated with the apparatus 10 simply by repeating, for each of these remote devices 20, the aforementioned steps of the initial configuration procedure. Once this initial configuration procedure has been completed, it is possible to access through each remote device 20 one or more of the following functions of the apparatus 10:

the setting of the predefined time slots for activating the communication between the user interface device 16 and the remote device 20;

the management of the connection modes for connecting the remote device 20 to the apparatus 10;

the settings of the network interface device 18, such as the Wi-Fi connection settings;

the settings of the user interface device 16, such as the settings of the tactile touch screen, the video camera 32, the microphone 34 and/or the speaker 36, or even the localization settings for locating this user interface device 16 (language, keyboard, etc.);

the cloud server settings 24, 26.

At least some of the aforementioned functions are, therefore, also accessible remotely to allow, for example, the owner of the apparatus 10 to cancel the call service, or to command an instant opening of this apparatus 10. All remote settings can be carried out by sending messages ("chat") via the VoIP server 26. In this case, too, messages can be sent using applications existing on the market, without the need for dedicated software development.

The apparatus 10 can be configured to independently request to one of the cloud servers 24, 26, concurrently with the first connection with a specific remote device 20, a pair of VoIP addresses, one for the apparatus 10 itself and one for this specific remote device 20. These VoIP addresses will be registered in the dedicated cloud server 24, 26, that is the VoIP server 26. The apparatus 10 will then be able to communicate, that is to call and receive calls, only with one or more specific remote devices 20 defined by the owner of the apparatus 10 itself.

The installation of a specific software for managing and connecting the apparatus 10 is foreseen on each remote device 20. In the remote device 20 configuration section this software can, therefore, show a configuration QR code which will enable, with a single operation, the configuration of the remote device 20 using both commercial applications, such as Linphone or Zoiper, and a specific configuration application ("app") specifically designed to simplify all the configuration and control options of this remote device 20. Thanks to these applications the owner of the apparatus 10 will be able, by exploiting the video camera 32 which can equip said apparatus 10, to receive video calls, manage messages and send inputs to the apparatus 10. For example, the owner of the apparatus 10 can establish a video call towards this apparatus 10 using his/her own remote device 20, thus activating a video surveillance function.

It has thus been shown that the method of operating an interactive electronic apparatus for receiving mail and goods in general according to the present invention achieves the objects highlighted above.

The method of operating an interactive electronic apparatus for receiving mail and goods in general according to the present invention thus conceived is, however, susceptible of numerous modifications and variations, all of which falling within the scope of the same inventive concept; furthermore, all the details can be replaced by technically equivalent elements.

The scope of protection of the invention is therefore defined by the attached claims.

The invention claimed is:

1. A method of operating an apparatus (10) for receiving one or more mail items, wherein the apparatus (10) comprises:

a body (12) provided with an internal cavity arranged to contain at least one said mail item;

at least one movable closure element (14), arranged to allow or prevent access to said internal cavity;

at least one user interface device (16), configured for allowing the input and output of audio and video signals;

at least one network interface device (18), configured for putting said user interface device (16) in communication with at least one remote device (20); and at least one electronic control unit (22), configured for controlling and managing said user interface device (16), said network interface device (18) and said movable closure element (14), the method comprising the steps of:

activating the communication between said user interface device (16) and said remote device (20);

generating, by said electronic control unit (22), at least one random alphanumeric code;

sending, via said network interface device (18), the random alphanumeric code to said remote device (20);

sending, by said remote device (20) and via said network interface device (18), an unlock signal based on said random alphanumeric code to said electronic control unit (22), said unlock signal being processed by said electronic control unit (22) to unlock said movable closure element (14) and to allow said mail item to be introduced in or withdrawn from the internal cavity of said body (12).

2. The method according to claim 1, wherein the audio and video signals comprises an audio or video or text message, and wherein said user interface device (16) is configured for sending the audio or video or text message, via said network interface device (18), to said remote device (20) in the event of non-activation of the communication between said user interface device (16) and said remote device (20).

3. The method according to claim 1, wherein all information or data exchanged between said apparatus (10) and said remote device (20) are managed by one or more cloud servers (24, 26).

4. The method according to claim 3, wherein the audio and video signals comprise one or more audio-video calls that use a VoIP technology, and wherein the communication between said user interface device (16) and said remote device (20) is carried out through the one or more audio-video calls that use a VoIP technology.

5. The method according to claim 4, wherein at least one of said cloud servers (24, 26) is a dedicated VoIP server (26).

6. The method according to claim 3, comprising an initial configuration step for configuring said apparatus (10), comprising in its turn the following sub-steps:

acquiring, by said remote device (20), a unique code associated with said apparatus (10);

transmitting said unique code to said one or more cloud servers (24, 26) via said user interface device (16);

registering said unique code and one or more predefined data associated with said remote device (20) on said one or more cloud servers (24, 26).

7. The method according to claim 6, wherein through said remote device (20) access is provided to one or more of the following functions of said apparatus (10):

setting of predefined time slots for activating the communication between said user interface device (16) and said remote device (20);

management of connection modes for connecting said remote device (20) to said apparatus (10);

settings of said network interface device (18);
settings of said user interface device (16); and
settings of said cloud servers (24, 26).

8. The method according to claim 6, wherein said apparatus (10) is configured for autonomously requesting to one of said cloud servers (24, 26), concurrently with a first connection with said remote device (20), a pair of VoIP addresses, one for said apparatus (10) and one for said remote device (20), said VoIP addresses being registered in one of said cloud servers (24, 26), so that said apparatus (10) can only communicate with one or more said remote devices (20) defined by the owner of said apparatus (10).

9. The method according to claim 1, wherein said apparatus (10) is provided with at least one video camera (32) and an audio input (34) and output (36) system, so as to establish a video call between said remote device (20) and said apparatus (10) for activating a video surveillance function.

10. The method according to claim 1, wherein said apparatus (10) is provided with at least one power supply device (28) and one or more solar panels (30) or other renewable energy sources, so as to implement an autonomous charging mode for charging said power supply device (28) by said one or more solar panels (30) or other renewable energy sources.

* * * * *